United States Patent [19]

Habich et al.

[11] 4,315,694

[45] Feb. 16, 1982

[54] CARRIER FOR PRINT ELEMENT AND RIBBON CARTRIDGES

[75] Inventors: Adolph B. Habich; Ronald E. Hunt, both of Austin, Tex.

[73] Assignee: International Business Machines Corporation, Armonk, N.Y.

[21] Appl. No.: 53,649

[22] Filed: Jun. 29, 1979

[51] Int. Cl.[3] ..... B41J 1/30

[52] U.S. Cl. ..... 400/144.2; 400/55; 400/59; 400/175; 400/208; 400/434.2

[58] Field of Search ..... 400/55, 56, 57, 58, 400/59, 60, 144, 144.1, 144.2, 144.3, 144.4, 146, 171, 174, 175, 208, 434.2; 101/111

[56] References Cited

U.S. PATENT DOCUMENTS

| | | | |
|---|---|---|---|
| 3,960,256 | 6/1976 | Bickoff et al. | 400/59 X |
| 3,983,803 | 10/1976 | Thomas et al. | 400/59 X |
| 4,023,662 | 5/1977 | Perucca | 400/59 X |
| 4,046,245 | 9/1977 | Frechette | 400/144.2 X |
| 4,049,109 | 9/1977 | Plaza et al. | 400/144.2 X |
| 4,075,945 | 2/1978 | Bienholz | 400/146 X |
| 4,086,997 | 5/1978 | Wu | 400/59 X |
| 4,111,293 | 9/1978 | Kockler et al. | 400/144.2 X |
| 4,124,312 | 11/1978 | Johnson | 400/175 X |
| 4,127,335 | 11/1978 | Bogert et al. | 400/175 X |
| 4,134,695 | 1/1979 | Randolph | 400/59 X |
| 4,161,373 | 7/1979 | Chvatlinsky | 400/144.2 X |
| 4,202,639 | 5/1980 | Rello | 400/144.2 X |

FOREIGN PATENT DOCUMENTS

| | | | |
|---|---|---|---|
| 2757993 | 6/1979 | Fed. Rep. of Germany | 400/208 |
| 2022022 | 12/1979 | United Kingdom | 400/144.2 |

OTHER PUBLICATIONS

IBM Technical Disclosure Bulletin, "Semiautomatic Print Wheel Loader", Cox et al., vol. 18, No. 10, Mar. 1976, p. 3356.

IBM Technical Disclosure Bulletin, "Impact Printer with Cassette Daisy Wheel Type Font", Roberti et al., vol. 22, No. 1, Jun. 1979, pp. 1-3.

IBM Technical Disclosure Bulletin, "Automated Printwheel Removal mechanism", Okcuoglu et al., vol. 22, No. 4, Sep. 1979, pp. 1538-1539.

"IBM Mag Card Adjustment Parts Manual", No. 241-5584-7, Jan. 1979.

"IBM Mag Card Service/Parts Manual", No. 241-59-92-0, Feb. 1978.

IBM Technical Disclosure Bulletin, "Latch", Habich et al., vol. 21, No. 10, Mar. 1979, pp. 3878-3879.

*Primary Examiner*—Ernest T. Wright, Jr.

*Attorney, Agent, or Firm*—James H. Barksdale, Jr.

[57] ABSTRACT

A daisy wheel printer carrier for print element and ribbon cartridges. The carrier is made up of a frame having a vertically oriented print element cartridge receptacle adjacent one end and support means for carrying a pivotable ribbon cartridge adjacent the other end. The frame is structured to be mounted on adjustable eccentric rails for slidable translation toward and away from a printer platen, and for orientation relative to the platen upon adjustment of the rails.

10 Claims, 6 Drawing Figures

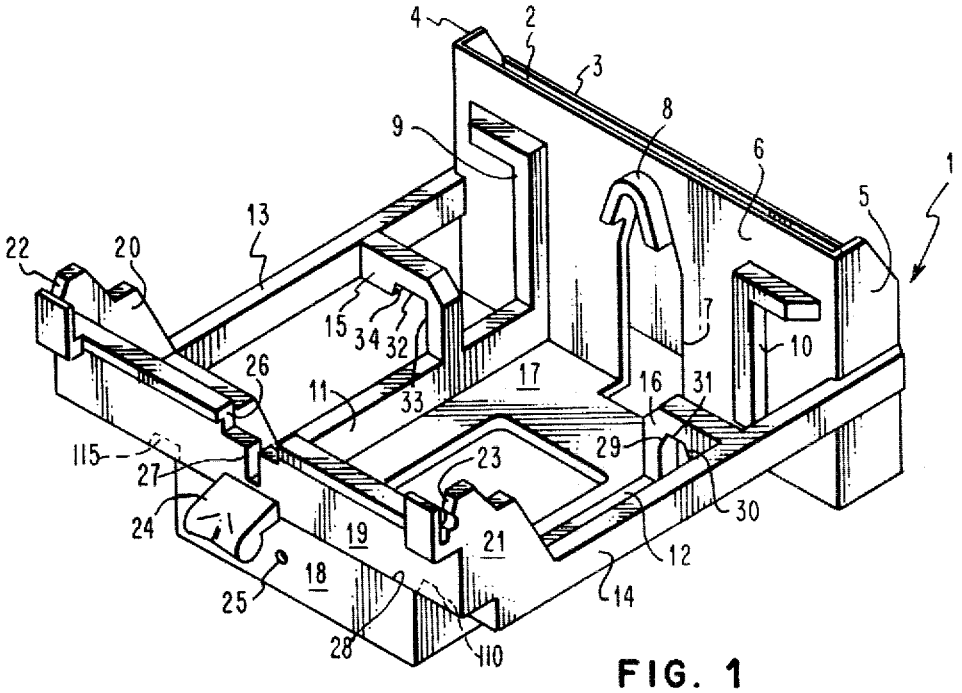
FIG. 1
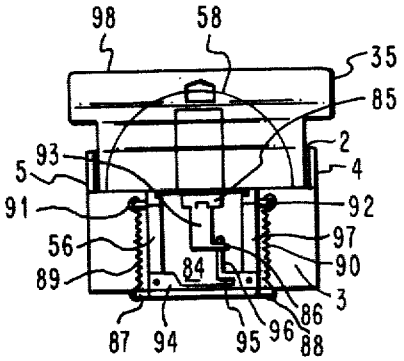
FIG. 4
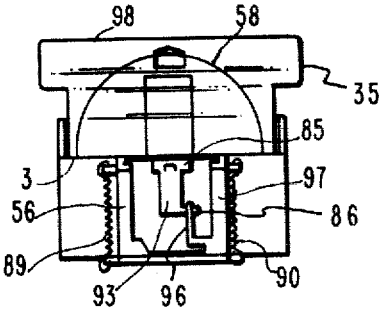
FIG. 6
FIG. 5
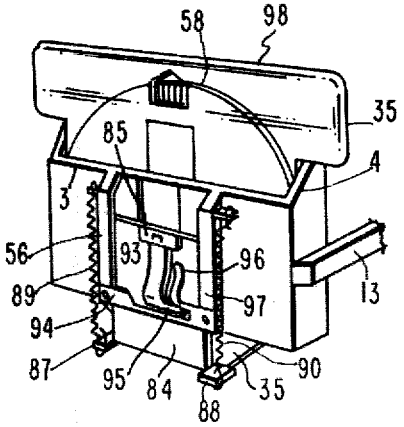

CARRIER FOR PRINT ELEMENT AND RIBBON CARTRIDGES

CROSS-REFERENCES TO RELATED APPLICATIONS

U.S. patent application Ser. No. 053,648, filed June 29, 1979, entitled "Method And Apparatus For Connecting And Disconnecting A Motor And A Print Element", and having A. B. Habich and R. E. Hunt as inventors.

U.S. patent application Ser. No. 053,646, filed June 29,1979, entitled "Daisy Wheel Printer Carrier" and having A. B. Habich and R. E. Hunt as inventors.

U.S. patent application Ser. No. 098,287, filed Nov. 28, 1979, entitled "Font Changing Apparatus For Daisy Wheel Printer", and having A. B. Habich and R. E. Hunt as inventors.

U.S. patent application Ser. No. 968,321, filed Dec. 11, 1978, entitled "Print Element Cartridge", and having A. B. Habich and R. E. Hunt as inventors.

U.S. patent application Ser. No. 968,322, filed Dec. 11, 1978, entitled "Print Element", and having A. B. Habich and R. E. Hunt as inventors.

U.S. patent application Ser. No. 968,320, filed Dec. 11, 1978, entitled "Print Package", and having A. B. Habich and R. E. Hunt as inventors.

BACKGROUND OF THE INVENTION

1. Field of the Invention

This invention generally relates to single element printer carriers. More specifically, this invention deals with a print element and ribbon cartridge carrier which is mountable, translatable, and adjustable upon a printer carrier.

2. Description of the Prior Art

Any number of single element printers are available in the marketplace today. The most common fall into the golf ball and daisy wheel categories. Typical of the golf ball printers are those utilized in the IBM Mag Card "Selectric"* Typewriter and IBM Mag Card II Typewriter systems. The printers in both of these systems have a carrier carrying a print element which is tiltable and rotatable for printing. The basic distinction between the carriers in the above mentioned systems is that escapement in the first is rack and pawl controlled, whereas in the latter escapement is pawl and leadscrew controlled.

*Registered Trademark—International Business Machines Corporation.

Somewhat typical of the daisy wheel printers on the market today is that used in the IBM 6240 Mag Card Typewriter system. The printer of this system has a carrier carrying a selection motor and a ribbon cartridge. The selection motor has a hub to which is connected a daisy wheel print element. The print element is rotatable for character selection during printing.

In the printers mentioned above, adjustment to provide for paper handling and to obtain a desired quality of printing is somewhat complicated and time consuming. This is the case during both assembly and repair.

Other prior art related to daisy wheel printers include U.S. patent application Ser. No. 767,250 to Bogert et al. (now U.S. Pat. No. 4,127,335), filed Feb. 10, 1977, and U.S. Pat. No. 4,124,312 to Johnson. In both of these references, a carrier is disclosed for carrying a daisy wheel print element housed in a cartridge, a ribbon cartridge, and a selection motor.

Not shown or utilized in any of the above mentioned prior art is a print element and ribbon cartridge carrier which is mountable along with a selection motor on a motor carrier, adjustable along with the motor for proper orientation relative to a platen, permits independent translation of the motor toward and away from the platen, and is adjustable toward and away from the platen to control the spacing between the motor and a print element, and the platen. In contrast, each of these features are attributable to the carrier of this invention in order to accommodate paper handling and obtain high quality printing.

SUMMARY OF THE INVENTION

A carrier is provided for print element and ribbon cartridges. This cartridge carrier is mountable upon rotatably adjustable eccentric rails of a daisy wheel printer carrier. Also mountable upon the eccentric rails, but independent of the cartridge carrier, is a selection motor, carrying a print hammer. On the end of the cartridge carrier adjacent a platen is a vertically oriented receptacle. This receptacle is for housing a cartridge having a print element therein and a cardholder on the top thereof. On the end of the selection motor shaft is a drive hub which is engagable with the print element for rotating the print element during printing. On the opposite end of the cartridge carrier is means for supporting a ribbon cartridge. The ribbon cartridge is pivotable between a horizontal printing position and a vertical print element change position. The end of the cartridge carrier having support means for the ribbon cartridge also has means for accepting an adjusting means for translating the cartridge carrier toward and away from the platen. The cartridge carrier is structured to permit the selection motor to be independently translated along the eccentric rails toward and away from the platen upon a pivoting of the ribbon cartridge. Upon rotation of the eccentric rails, the selection motor and cartridge carrier are both oriented relative to the platen to obtain high print quality. Upon adjustment of the adjusting means, the cartridge carrier is translated along the eccentric rails for varying the spacing between the platen, and the cardholder and print element for paper handling purposes and to obtain high print quality.

BRIEF DESCRIPTION OF THE DRAWING

FIG. 1 is a perspective view of a cartridge carrier according to this invention.

FIG. 4 is a front end view of the cartridge carrier illustrating push-to-latch, push-to-unlatch structure for a print element cartridge with the print element cartridge in an unlatched state prior to a latching operation.

FIG. 5 is a perspective view similar to FIG. 4 with the print element cartridge in a latched state following a push-to-latch operation.

FIG. 6 is a front end view similar to FIGS. 4 and 5 with the print element cartridge in an unlatched state following a push-to-unlatch operation.

DESCRIPTION OF THE PREFERRED EMBODIMENT

Figure 2:
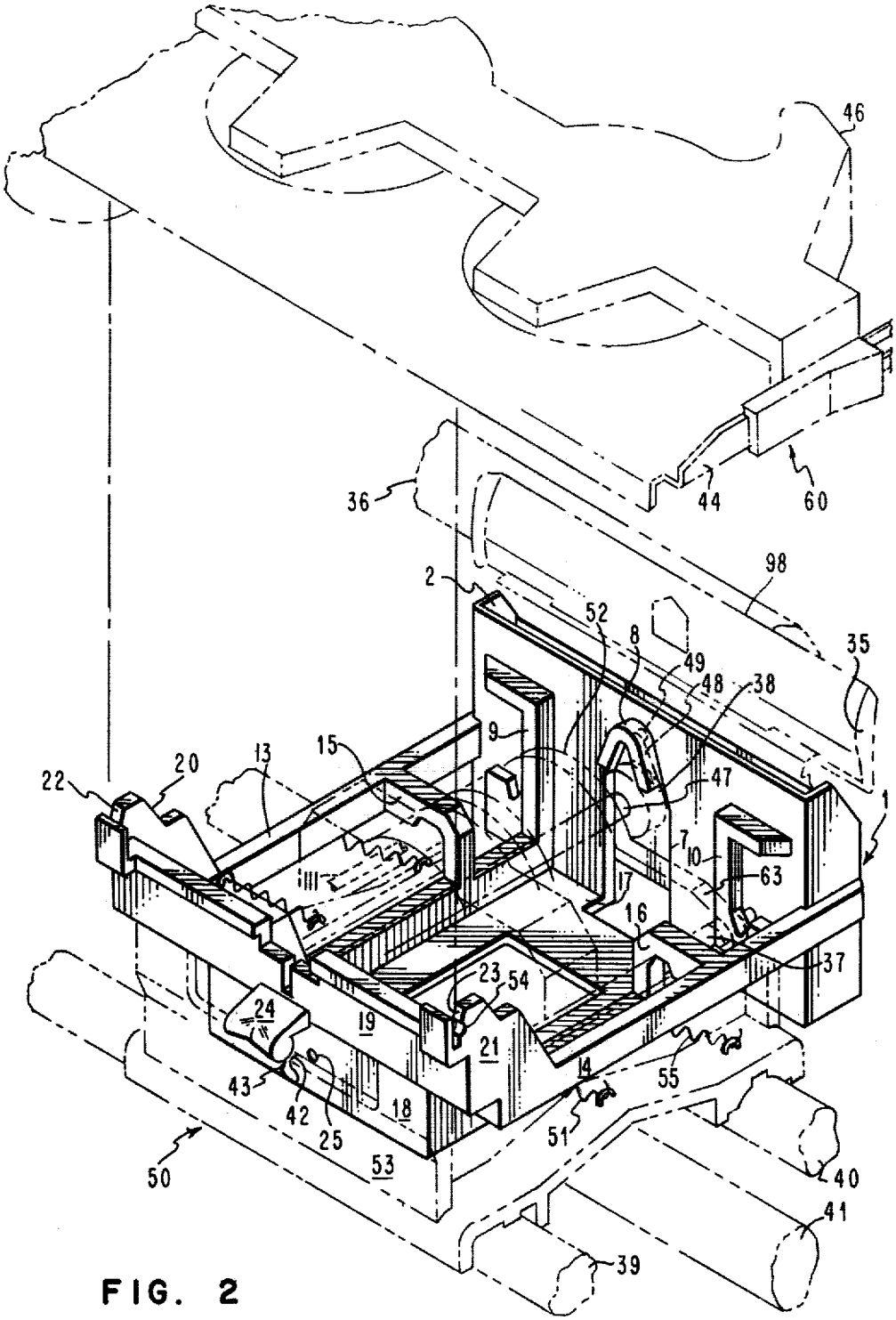
FIG. 2 is a perspective view primarily illustrating the structure and relationship of apparatus cooperating with the cartridge carrier of this invention.

For a more detailed understanding of the invention, reference is first made primarily to FIG. 1. In this figure is shown the bulk of the cartridge carrier generally designated by reference numeral 1. Cartridge carrier 1 is preferably one piece made up of a molded rigid plastic. Carrier 1 has a vertically oriented print element cartridge receptacle 2 having a front wall 3, side walls 4 and 5 and a rear wall 6. Within rear wall 6 is an opening 7 for accepting a drive hub 38 (FIG. 2) for a daisy wheel print element 58 (FIG. 4). Drive hub 38 is connected to a selection motor drive shaft 47 (FIG. 2). At the top of opening 7 is a dormer 8 which serves as a homing means. Dormer 8 maintains drive hub 38 in a home position when not in engagement with print element 58.

Figure 3:
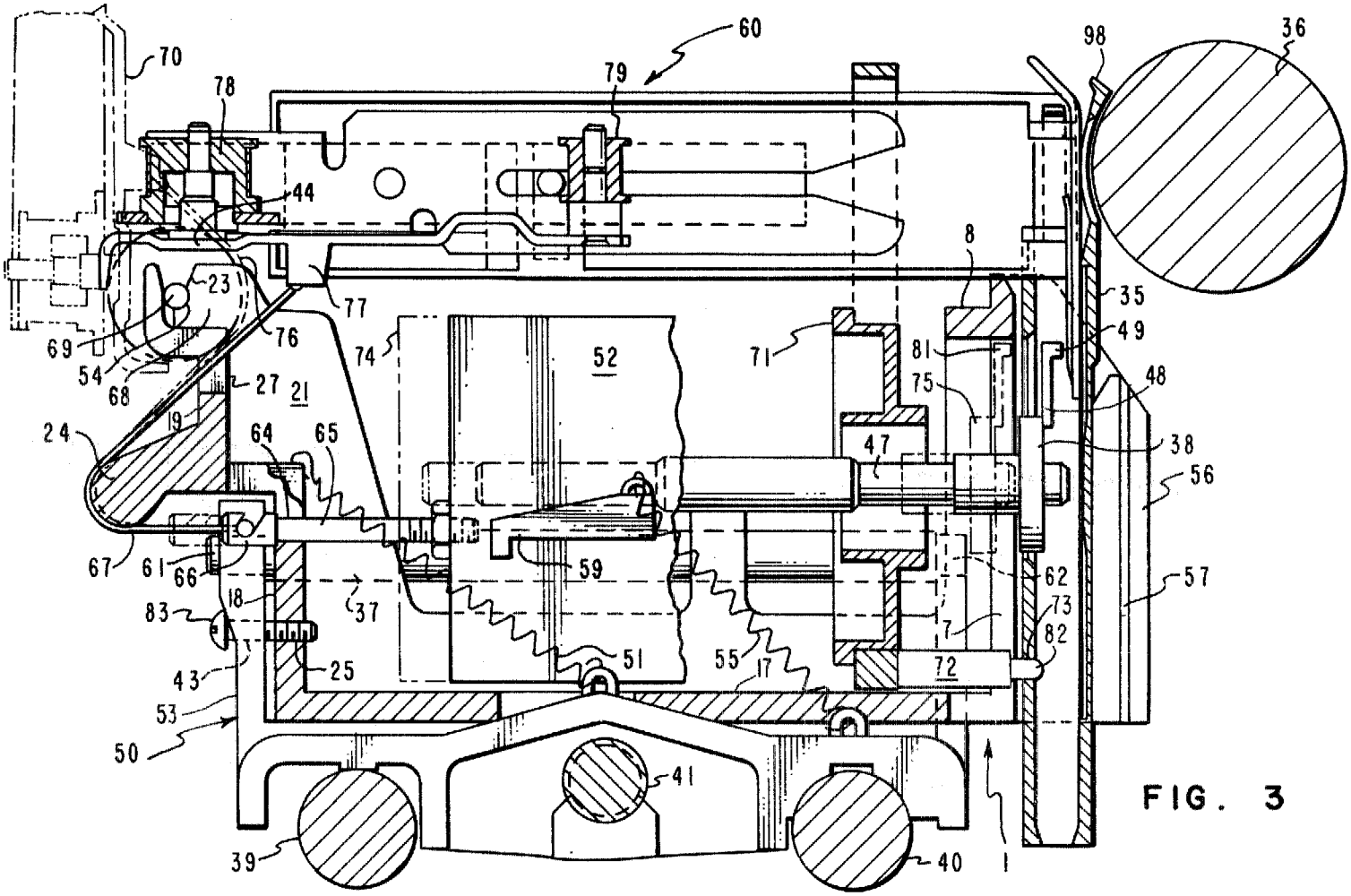
FIG. 3 is a side view of the structure illustrated in FIG. 2.

Integral with rear wall 6 are "L" shaped reinforcing ribs 9 and 10. Ribs 9 and 10 are in turn connected to lower side ribs 11 and 12. Integral with side walls 4 and 5 are upper side ribs 13 and 14. Supported by lower ribs 11 and 12 and upper ribs 13 and 14 are hanging brackets 15 and 16. The purpose and detailed structure of hanging brackets 15 and 16 will be set out in more detail later herein. Integral with rear wall 6 and lower ribs 11 and 12 is a bottom 17. Connected to lower ribs 11 and 12 and bottom 17 is a back 18. Above back 18 is a rear rib 19 which, in conjunction with upper ribs 13 and 14, carry upwardly extending supports 20 and 21. Supports 20 and 21 are for supporting a ribbon cartridge plate or mounting bracket 44 (FIG. 2). Bracket 44 is mountable within recesses 22 and 23 by means of an elongated rod 69 (FIG. 3). Integral with rear rib 19 is a tongue 24 around which a cable 67 (FIG. 3) is wrapped. Within rear rib 19 is a cutout 26 having a vertically extending slot 27 through which cable 67 moves as will be described later herein.

Within hanging bracket 16 is a recess having beveled surfaces 29 and 30 and a top surface 31. A similar recess 110 is located beneath the right end of a lip 28 of rear rib 19. The recesses thus described within bracket 16 and beneath lip 28 are for accepting an eccentric rail 37 (FIG. 2). Within hanging bracket 15 is a recess having side surfaces 33 and 34 and a top surface 32. Surfaces 33 and 34 can be beveled or angularly projecting as are those within the recess of hanging bracket 16. In any event though, surfaces 33 and 34 are spaced further apart than surfaces 29 and 30. This is because the beveled surfaces 29 and 30 are for positively locating carrier 1 on eccentric rail 37. A recess 115 similar to that in hanging bracket 15 is located under the left end of lip 28. The recess 110 under the right end of lip 28 is aligned with the recess in bracket 16 for accepting eccentric rail 37. A recess 115 under the left end of lip 28 is aligned with the recess in bracket 15 for accepting eccentric rail 111 extending parallel to rail 37. Top surfaces 32 and 116 and beveled surfaces 29 and 30 are for riding against the tops of eccentric rails 37 and 111.

Refer next to FIG. 2. Cartridge carrier 1 is structured to be mounted upon a printer carrier generally designated by reference numeral 50. Carrier 50 includes the above-mentioned spaced parallel eccentric rails 37 and 111. It is upon these eccentric rails 37 and 111 that cartridge carrier 1 is mounted via the above-mentioned recesses, such as those in brackets 15 and 16. Also mountable upon the eccentric rails 37 and 111 is a selection motor 52 having rotatable shaft 47. As pointed out above, drive hub 38 is connected to the end of shaft 47. Drive hub 38 has an extension 48 carrying an offset drive pin 49. Hub 38 and pin 49 are engageable with print element 58 for rotating element 58 in a print element cartridge 35 during printing. Cartridge 35 has an integral cardholder 98 and is housed in receptacle 2 during printing. Cartridge 35 is vertically insertable into receptacle 2 from the top thereof. Print element 58 is insertable into cartridge 35 from the bottom thereof. When cartridge 35 is inserted into receptacle 2, cardholder 98 will be located adjacent a print platen 36.

Printer carrier 50 is mountable upon escapement rails 39 and 40 and translated along platen 36 by a lead-screw 41.

Escapement rails 39 and 40 are parallel and extend between the sides of a printer frame (not shown). Positioned in different planes are leadscrew 41 and platen 36 which are parallel to escapement rails 39 and 40. Disposed in yet another plane are the above-mentioned eccentric rails 37 and 111 which are parallel and extend perpendicular to a plane passing vertically through platen 36. Carrier 1 is biased downwardly and to the right against the eccentric rails 37 and 111 of carrier 50 by springs such as 51. Also mountable upon the escapement rails 39 and 40 is a selection motor 52.

Within back 18 of carrier 1 is an opening 25. Within back 53 of carrier 50 is a vertically extending slot 42 terminating in a cylindrical opening 43. When carrier 1 is mounted on carrier 50, opening 25 and 43 are aligned. Opening 43 is for freely accepting a screw 83 (FIG. 3) which is threaded into opening 25. Since carrier 1 is biased to the right, rotation of screw 83 will result in translation of carrier 1 on carrier 50 toward and away from platen 36. The adjustment of carrier 1 upon rotation of screw 83 is to control the spacing between cardholder 35 and platen 36 to provide for paper handling and to obtain high quality printing. The spacing between cardholder 35 and platen 36 must be wider for multiple carbons and/or forms than for a single sheet. Also, print element 58 must not be spaced too far or too close to platen 36 or low quality printing will result.

Within recesses 22 and 23 in supports 20 and 21 are cylindrical portions such as 54 in recess 23. These cylindrical portions such as 54 are for accepting studs or a rod 69 upon which ribbon cartridge plate 44 is hinged. Ribbon cartridge plate 44 forms part of a ribbon cartridge mechanism generally designated by reference numeral 60. Cartridge mechanism 60 has a spool housing 46.

Reference is next made to FIG. 3 wherein there is illustrated in further detail the relationship between carriers 1 and 50, cartridge mechanism 60, and a selection motor 52. As has been pointed out, carrier 50 is translatable along platen 36 on escapement rails 39 and 40 upon rotation of leadscrew 41. Carrier 1 and motor 52 are independently mountable upon eccentric rails 37 and 111. Selection motor 52 has a rear mounting bracket 59 having a recess similar to the recess in mounting bracket 16. Also, motor 52, having front motor end bell 71, has a mounting bracket 63 (FIG. 2) similar to mounting bracket 16 for mounting motor 52 on rail 37. Eccentric rail 37 has end portions 61 and 62. End portions 61 and 62 both have the same axis of rotation which is offset from the axis of rotation of the remainder of rail 37. With this being the case, rotation of rail 37 results in carrier 1 and motor 52 being cammed up and down for adjusting the point at which printing is to occur on platen 36. Since eccentric rails 37 and 111 are on different sides of carrier 1, both must be similarly rotated for adjusting carrier 1 in the vertical direction. Rotation of one or the other of the eccentric rails 37 and 111, or rotation of the eccentric rails 37 and 111 a different extent will result in carrier 1 being oriented relative to platen 36. With the recess in bracket 15 being wider than the recess in bracket 16, carrier 1 can slide along platen 36 upon rotation of rail 37. Thus, the recess in bracket 15 is a sliding recess.

When motor 52 is in its withdrawn position 74 shown in dotted lines, hub 38 and its drive pin 49 will be in positions 75 and 81 shown in dotted lines. The solid line position shown for selection motor 52 is its operating position. When in this position, a locating key 72 connected to mounting bracket 63 has its extending end 82 positioned in an opening 73 in cartridge 35. Motor 52 is biased downwardly and to the right against eccentric rail 37 by a spring 55.

Secured to the rear of motor 52 is an anchor bolt 65 having a slotted hub 66. Anchor bolt 65 extends through an opening 64 in carrier 1. Connected to slotted hub 66 is a cable 67. Cable 67 is threaded around tongue 24 and connected to anchoring protuberance 77 on cartridge mechanism 60. When motor 52 is in its operating position, cartridge mechanism 60 will be in the position shown. When ribbon cartridge mechanism 60 is lifted and pivoted to dotted line position 70, cable 67 will be wrapped around a circular shaped cam 68. The pivoting of cartridge mechanism 60 to position 70 will result in motor 52 being translated to position 74. Cam 68 is secured to the lower surface of plate 44. When cartridge mechanism 60 is in position 70 and motor 52 is in position 74 cable 67 will be in the dotted line position 76. Cartridge mechanism 60 is pivotable about rod 69 which is fitted in cylindrical portion 54 of recess 23. Cartridge mechanism 60 has supply and drive spools such as 79 and 78, respectively.

Located on, and integral with, the front of carrier 1 is a latch rib 56. Rib 56 has a vertical slot 57 therein. In referring next to FIG. 4, slot 57 is for maintaining a plate 84. Rib 56, slot 57, and plate 84 form part of a push-to-latch, push-to-unlatch mechanism for maintaining cartridge 35 in, and releasing cartridge 35 from, receptacle 2. As pointed out above, print element cartridge 35 is for housing a daisy wheel print element 58 during printing operations.

Before cartridge 35 is inserted into receptacle 2, cartridge mechanism 60 is pivoted to position 70 and motor 52 is withdrawn to position 74. The reason for this is that a ribbon in cartridge mechanism 60 and hub 38 must be displaced to non-interfering positions. Following a ribbon lift and motor withdrawal operation upon the pivoting of cartridge mechanism 60, cartridge 35 can be freely inserted into receptacle 2. During insertion of cartridge 35 into receptacle 2, the bottom of cartridge 35 will bottom against spring retainers and cartridge stops 87 and 88. The operator procedure is to then push down on the top of cardholder 98.

Before discussing further operator operations and procedures, the details of the push-to-latch, push-to-unlatch mechanism will be described. Connected to stops 87 and 88 are the lower ends of tension springs 89 and 90. The upper ends of tension springs 89 and 90 are connected to spring hooks 91 and 92, respectively. Hooks 91 and 92 are connected to front 3 adjacent latch ribs 56 and 97. Rib 97 has a slot therein similar to slot 57 in rib 56. Also connected to stops 87 and 88 is plate 84. The left edge of plate 84 is slidably fitted in slot 57 and the right edge of plate 84 is slidably fitted in the corresponding slot in rib 97. Secured to the top of plate 84 is a leaf spring ladle 85 having a handle 93 and a bucket 86. Secured to the bottom outside of ribs 56 and 97 is a leaf spring clip 94 having a slot 95 and a ramp portion 96.

Assuming that cartridge 35 has just been inserted into receptacle 2 and is in the position shown in FIG. 4, bucket 86 is located on the outside of ramp portion 96. Bucket 86 has an outer lip which extends higher than an inner lip. For latching cartridge 35 in receptacle 2, downward pressure is applied to cardholder 98 for lowering cartridge 35. Cartridge 35 is lowered until the inner lip of bucket 86 passes through slot 95. When bucket 86 passes through slot 95 the outer lip of bucket 86 will contact clip 94 above slot 95. This will result in an audible feedback to the operator for alerting the operator to cease applying downward pressure to cardholder 98.

When downward pressure is no longer applied, cartridge 35 will restore a limited extent in the upward direction. During this restoration, the bottom of bucket 86 will have the top of slot 95 seated therein. Following seating, the components will be in the position shown in FIG. 5. When in such position, cartridge 35 is latched in a down position.

For a push-to-unlatch operation, an operator will apply a downward pressure to cardholder 98 for lowering cartridge 35. When cartridge 35 has been lowered sufficiently for the outer lip of bucket 86 to pass through slot 95, unlatching is complete and cartridge 35 is free to restore in the upward direction under the influence of springs 89 and 90. During this upward restoration, the outer lip of bucket 86 will ride up the inside of ramp 96 to the position shown in FIG. 6.

Further structural and conceptual details of the push-to-latch, push-to-unlatch mechanism are set out in IBM Technical Disclosure Bulletin Vol. 21, No. 10, March 1979, pp. 3878 and 3879 entitled "Latch" by A. B. Habich et al.

In summary, a carrier is provided for print element and ribbon cartridges. This cartridge carrier is mountable upon rotatably adjustable eccentric rails of a daisy wheel printer carrier. Also mountable upon the eccentric rails, but independent of the cartridge carrier, is a selection motor, carrying a print hammer. On the end of the cartridge carrier adjacent a platen is a vertically oriented receptacle. This receptacle is for housing a cartridge having a print element therein and a cardholder on the top thereof. On the end of the selection motor shaft is a drive hub which is engagable with the print element for rotating the print element during printing. On the opposite end of the cartridge carrier is means for supporting a ribbon cartridge. The ribbon cartridge is pivotable between a horizontal printing position and a vertical print element change position. The end of the cartridge carrier having support means for the ribbon cartridge also has means for accepting an adjusting means for translating the cartridge carrier toward and away from the platen. The cartridge carrier is structured to permit the selection motor to be independently translated along the eccentric rails toward and away from the platen upon a pivoting of the ribbon cartridge. Upon rotation of the eccentric rails, the selection motor and cartridge carrier are both oriented relative to the platen to obtain high print quality. Upon adjustment of the adjusting means, the cartridge carrier is translated along the eccentric rails for varying the spacing between the platen, and the cardholder and print element for paper handling purposes and to obtain high print quality.

While the invention has been particularly shown and described with reference to a preferred embodiment it will be understood by those skilled in the art that various other changes in form and detail may be made without departing from the spirit and scope of the invention.

What is claimed is:

1. A carrier for both a ribbon cartridge and a print element cartridge, said carrier comprising:

(a) a vertically oriented print element cartridge receptacle located in the front of said carrier;

(b) means located in the top rear of said carrier for supporting said ribbon cartridge; and (c) a plurality of hanging bracket means oriented horizontally between said receptacle and said supporting means for supporting said carrier on a number of adjustable eccentric rails of a printer carrier for translation toward and away from a printer platen and orientation relative to said printer platen.

2. A carrier according to claim 1 including means for connecting said receptacle, said supporting means, and said hanging bracket means.

3. A carrier according to claim 2 including an opening in the rear of said receptacle for accepting a horizontally positionable selection motor drive hub.

4. A carrier according to claim 3 including orientation means adjacent said opening for maintaining said hub in a home position when said hub is positioned in said orientation means.

5. A carrier according to claim 4 wherein one of said hanging bracket means includes a locating recess for positively locating said carrier on said printer carrier.

6. A carrier according to claim 5 wherein another of said hanging bracket means includes a sliding recess.

7. A carrier according to claim 6 including means for accepting an adjustment means for adjusting said carrier horizontally.

8. A carrier according to claim 7 including a slot located in the top rear of said carrier for accepting a connecting means for connecting a selection motor to said ribbon cartridge.

9. A carrier according to claim 8 including a tongue projecting from the rear of said carrier and around which said connecting means is wrapped.

10. A carrier according to claim 9 including means located on the front of said receptacle for accepting push-to-latch, push-to-unlatch mechanism for maintaining a print element cartridge in, and releasing said print element cartridge from, said receptacle.

* * * * *